United States Patent [19]

Brown

[11] 4,244,564

[45] Jan. 13, 1981

[54] CONTROL SYSTEM FOR A COLLATOR

[75] Inventor: Michael A. Brown, Norwalk, Conn.

[73] Assignee: Pitney Bowes Inc., Stamford, Conn.

[21] Appl. No.: 41,670

[22] Filed: May 23, 1979

Related U.S. Application Data

[63] Continuation of Ser. No. 868,647, Jan. 11, 1978, abandoned, which is a continuation-in-part of Ser. No. 726,145, Sep. 24, 1976, abandoned.

[51] Int. Cl.[3] ..... B42B 2/00; B65H 39/055

[52] U.S. Cl. ..... 270/53; 270/58

[58] Field of Search ..... 270/58, 53; 271/256–258

[56] References Cited

U.S. PATENT DOCUMENTS

| | | | |
|---|---|---|---|
| 2,821,384 | 1/1958 | Mendes | 270/58 |
| 3,098,650 | 7/1963 | Keil | 271/256 |
| 3,173,680 | 3/1965 | Dezoppy | 270/58 |
| 3,536,318 | 10/1970 | Gay | 270/58 |
| 3,664,656 | 5/1972 | Ryland | 270/58 |
| 3,773,313 | 11/1973 | Bassett | 270/58 |
| 4,053,149 | 10/1977 | Paulus | 270/58 |
| 4,073,391 | 2/1978 | O'Brien | 270/58 |

*Primary Examiner*—Edgar S. Burr
*Assistant Examiner*—A. Heinz
*Attorney, Agent, or Firm*—Lawrence E. Sklar; William D. Soltow, Jr.; Albert W. Scribner

[57] ABSTRACT

A control system for a collator or a combined collator-set finishing machine stops the machine in a home position in case of a sheet feeding malfunction or operation of a stop switch. A collator has a plurality of bins for storing sheets that are to be collated into sets. Sheet feeders move from a home position to engage and eject a sheet from each bin onto a conveyor for delivery to a jogger and stapler. Sensors are placed along the path of the sheets from the bins to the jogger for detecting a sheet feeding malfunction. A timing cam switch turns at a predetermined rate in timed sequence with the collating, jogging and set finishing operations. The timing cam actuates timing switches that cooperate with the sensors and with operator controlled switches to stop the machines in its home position. The stapler is also responsive to the sensors and is disabled when a sheet feeding malfunction is detected and is not enabled until the next cycle and may be operated independently of the collator.

18 Claims, 9 Drawing Figures

CONTROL SYSTEM FOR A COLLATOR

This is a continuation of application Ser. No. 868,647 filed Jan. 11, 1978, which in turn is a continuation-in-part of application Ser. No. 726,145 filed Sept. 24, 1976, both of which are now abandoned.

BACKGROUND OF THE INVENTION

1. Field of the Invention

The invention relates generally to a control system for controlling electromechanical operations of a collator-jogger set finisher, and more particularly pertains to a cycle cam switch and a system control circuit which controls collating, jogging, and stapling operations of a collator. The control system detects sheet feeding malfunctions and stops the machine in a home position.

DESCRIPTION OF THE PRIOR ART

A collator machine typically has a plurality of adjacent bins for storing sheets of sorted material. The bins may be arranged in a horizontal array of vertically oriented bins (as more fully discussed hereinafter) or a vertical array of horizontally oriented bins. A corresponding plurality of sheet feeders are operatively associated with the bins. The sheet feeders have pusher arms for ejecting a sheet from a bin. The pusher arms cyclically travel along a circuitous path starting from a home position out of contact with the sheets, to engaging the sheets, moving the sheets upwardly to eject them, and returning to the home position.

A conveyor is disposed along the upper ends of the bins for conveying the ejected sheets to a set finisher. The set finisher comprises a jogger which aligns the edges of the sheets and a stapler which fastens together the collated, jogged set. The jogger has a pair of side guides that reciprocate from an open position for receiving sheets to a closed position where the sides of a set of sheets are aligned. The jogger also has end stops against which one end of the sheets register and a back jogger which moves in synchronism with the side guides to align the other end of the sheets.

In the field of collator-jogger set finisher machines, it has been a general practice to utilize circuits to control electromechanical operations of the machines. Such circuits usually had jam detection systems consisting of microswitches positioned at critical feed points in the machine to detect sheets jammed in the sheet receiving storage bins, in a conveyor system, or in a jogger-set finisher. These microswitch detection systems of the prior art are unsatisfactory for a number of reasons. Under the control of such systems, a set finisher machine will stop when a jam or misfeed occurs which is usually in the middle of a collating cycle. If a jam occurs, it is necessary to remove all the sheets being collated. If a misfeed occurs, the machine will stop with the ejected sheets being left in their respective positions at the time the misfeed was detected. As a result, an operator must clear all the ejected sheets from the bins and the conveyor before resuming operation. In many cases the sheet pushers remained engaged and in contact with the paper, making jam clearing or reloading more difficult. Such operator activity is time consuming, thereby detracting from the advantages of collating with a machine. Accordingly, the collator control systems of the prior art are less than satisfactory as the collator-jogger set finisher would not complete and discharge an incomplete set of collated sheets and return the collator to a home position prior to beginning another cycle.

SUMMARY OF THE INVENTION

The present invention provides for a control system in a collator and in a combined collator-jogger set finisher machine for stopping the machine in a home position with the sheet pusher off the sheets. The control system includes sensing means for detecting a sheet feeding malfunction (misfeed or jam) in the bins. A cycle cam switch is responsive to said sensing means and is operatively connected to the sheet feeders for stopping the sheet feeders when they return to their home position. In that position the sheet feeder pusher arms are disposed away from the sheets stored in the bins, so that the bin may be reloaded without interference from the pushers and so that a jam in the machine can be easily cleared and the collator can be restarted at the beginning of the next cycle, rather than in mid-cycle like the collators controlled by other systems. Further control means are provided for disabling the stapler when a sheet feeding malfunction is detected. Still further means are provided for automatically ejecting an unfastened incomplete set from the jogger and for operating the set finisher independently of the collator.

More particularly, the cycle cam switch of the invention comprises a timing cycle cam having an array of switches operatively associated with the cam and electrically connected to a systems control circuit. The timing cam turns at a predetermined rate in synchronism with the operations of the machine. A stop switch and a pusher timing switch are activated by the timing cam. A miss detection control relay is electrically connected to a miss detection sensing means and, through a series of relays, to the power supply for the collator. Likewise, a jam detection control relay is electrically connected to a jam. detection sensing means and, through the same series of relays, to the power supply for the collator. The stop and pusher timing switches are periodically activated by the timing cam once during each cycle. If either detection sensing means detects a jam, its corresponding relay is opened but the collator continues to operate until either the stop or pusher timing switch is actuated by the timing cam whereupon the control systems circuit will interrupt power to the collator and the collator will come to rest in its home position with the sheet feeder pusher arms disposed away from the stacks of sheets stored in the bins and the side guides of the jogger in their closed position.

The miss detection sensing means comprises a plurality of switches operatively associated with a corresponding number of bins. An actuator arm for each switch is located in the path of the sheet feeder that is associated with each bin. Each actuator arm is disposed on a side of the bin opposite to the sheet feeder and juxtaposed to an aperture in the bin. When a sheet is fed, the sheet covers the aperture as the sheet feeder (pusher arm) ejects the sheet from the bin. When the sheet feeder fails to feed a sheet, the pusher arm enters the aperture and engages the miss detector actuator arm. Each miss detection switch is also connected to an SCR (silicon controlled rectifier) which, when activated, energizes an indicator light for indicating in which bin or bins the misfeed occurred.

The jam detection sensing means senses sheet jams in the flow path of the sheets from the bins to the jogger area. Jams in bins are detected by a photodetector system. The photodetector comprises a light signal source, a light signal receiver and a light path from the source to the receiver through a plurality of corresponding holes in the bins. The receiver is operatively connected to an amplifier and to a paper flow jam indicator light and to the pusher timing switch. The pusher timing switch is activated at a predetermined time by the timing cycle cam when the sheets ejected by the pushers should all be out of the bins. If one of the sheets is jammed in a bin, the control cycle stops the machine with the sheet feeders in the home position.

Another jogger jam detection sensing means is operatively associated with the sheet jogger for sensing jams at the entrance to the jogger. A sensitive switch has an actuator arm positioned in the vicinity of a back jogging member that aligns the back and sides of sheets delivered to the jogger. If a sheet is jammed at the entrance to the jogger, the back jogging member will move the jammed sheet into engagement with the activator arm of the sensitive switch. The sensitive switch is electrically connected through a third series of relays to the power supply for the collator and jogger. When the switch is actuated, the power to the machine is interrupted and the collator is stopped in its home position. Because the jogging function takes place at about the time the machine is in its home position, it is not necessary to operatively associate the jogger jam sensitive switch with the timing cam.

All of the sheet feeding malfunction detection sensing means are operatively associated through the systems control circuit with the stapler. The stapler is disabled whenever a malfunction is sensed by one of the detection means. The system control circuit also prevents the stapler from being reactivated until the next complete cycle is run.

Another feature of the control system is its capacity to allow a restart of the collator for one cycle after a misfeed is detected. After the machine has stopped in home position, the operator can activate the start button (without re-setting the miss relay) which energizes the power relay and drive motor running the machine one cycle until the cam switch senses the miss condition stopping the machine in home position again. In this manner an incomplete set may be automatically collated, jogged, but not stapled. That incomplete set may be put aside for later correction and the normal operation of the machine may be resumed.

Another feature of the control system is the provision to stop only in home position when the operator activates the stop control switch. In this position, the jogger guides are closed, allowing paper size adjustments to be checked and pushers are cammed off the paper, allowing easy reloading of the bins.

Still another feature of the control system is the provision of the controls for operating the set finisher independent of the collator. A mode selector switch can be activated to deactivate the collator. A jogger position and stapler actuation switch are operatively associated with the timing cam for controlling the operation of the set finisher to permit an operator to load, jog and staple one set of sheets at a time and stop the jogger in a new home position with its side guides open.

Having briefly described one embodiment of the present invention, it is an object thereof to provide a new and improved control system for a collator machine and a combined collatorjogger set finisher machine.

It is another object to provide a control system for stopping a collator in a home position when a sheet feeding malfunction is detected.

It is another object to provide a control system for stopping the collator in home position when the stop control is actuated.

It is another object to provide a control system for detecting a sheet feeding malfunction, collating an incomplete set of sheets and stopping the collator in a home position.

It is a further object to provide a control sysem for selecting a mode of operation during which the set finisher can be operated independently of the collator.

BRIEF DESCRIPTION OF THE DRAWINGS

These and other objects and advantages of this invention will be readily appreciated and better understood by reference to the following detailed description when considered in connection with the accompanying drawings where.

DESCRIPTION OF THE PREFERRED EMBODIMENT

Figure 1:
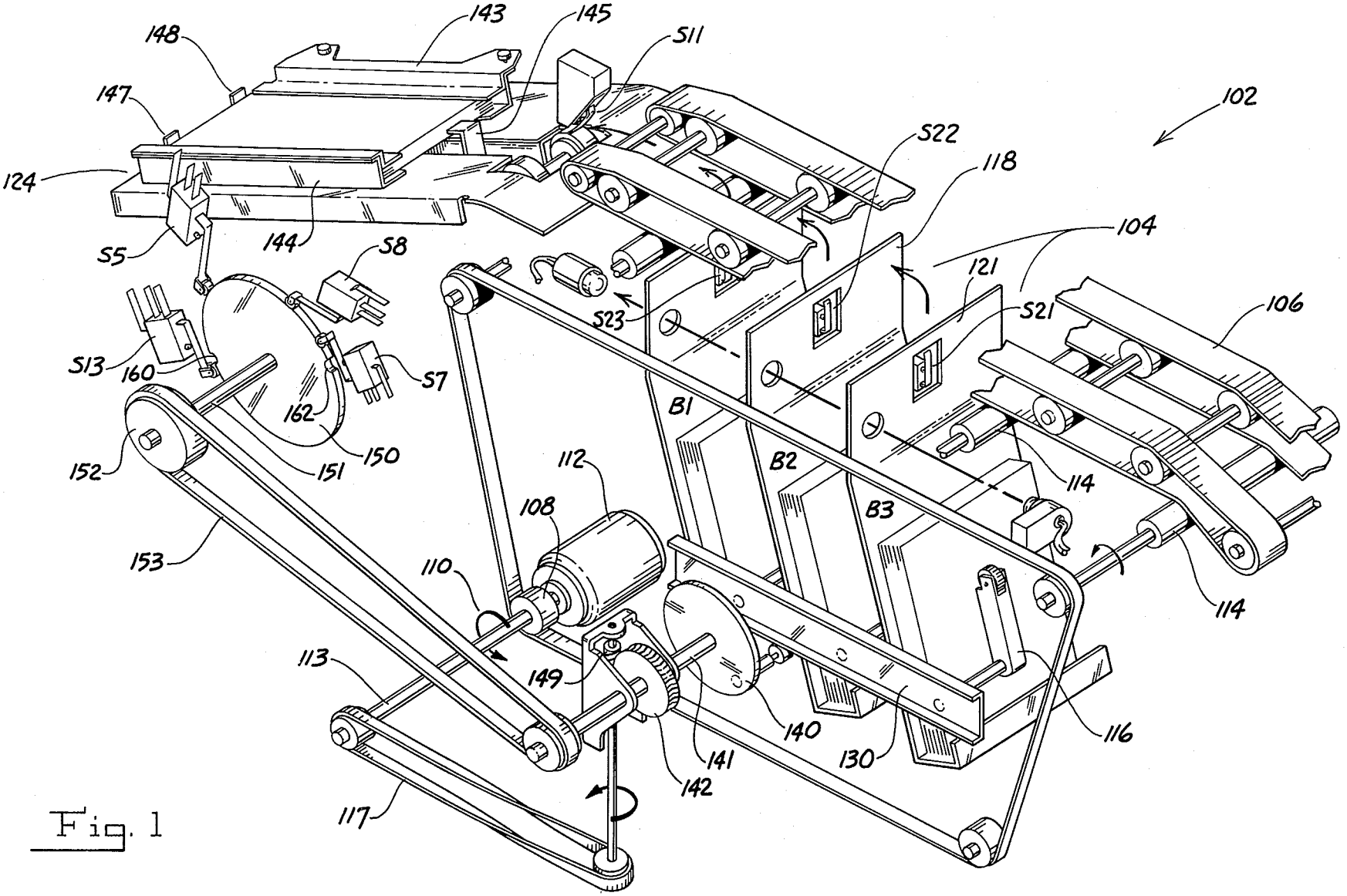
FIG. 1 is a partial perspective view of an embodiment of the invention where the control system is shown in a schematic representation of a collator-jogger set finisher.

Now referring to FIG. 1, a combined collator-jogger set finisher machine 102 is generally shown. The machine 102 is comprised of an array of bins 104 of which only three (B1, B2 and B3) are shown for the purpose of describing the control system of the present invention. When collating, sheets are ejected out of the top of the bin 104 into an overhead belt conveyor 106 that is driven by a driver roller 108 as shown by arrow 110. Drive roller 108 is mounted on the shaft of a drive motor 112. Below the overhead belt conveyor 106 is a series of rollers 114 which cooperate with the overhead conveyor 106 to form a transporting bite for sheets from the bins 104. The conveyor, rollers, motor, etc. are all supported on a frame (not shown) in a manner familiar to those skilled in the art.

Below the rollers 114 is disposed an array of sheet storage bins 104. Although only three bins are shown, any reasonable or suitable number consistent with the overall use objects or design capacity may be used. After the bins 104 are loaded with sheet material, conveyor 106 is actuated and the sheets are ejected from the bins 104 by means of a plurality of sheet feeders (pusher arms) shown generally by arrow 116. Each bin comprises a rear wall 118 against which sheets 138 rest, an end stop 119, and a forward wall 121 spaced from and parallel to wall 118. The pusher arms 126 will be explained with reference to FIGS. 1 and 2.

Ejected sheets are pushed against the wall 118 (see FIG. 2C), and are exited in the upward direction as generally shown by arrow 120 for engaging the overhead belt conveyor 106. The sheet 122 under the influence of the conveyor 106 is transported to a jogger set finisher 124.

Each of the pusher arms 126 is pivotally connected to a reciprocating vertically movable (arrow 128) rail 130 via a shaft 132. The rail 130 is slidably movable upon a frame (not shown). The pusher arm 126 is pivotable on shaft 132 in order to follow the contours of wall 118. As will be observed, the wall 118 has a foward angle bend 134 at the upper portion thereof. The purpose of this forward bend will become more apparent with the following discussion of the operation of pusher arm 126.

Figure 2:
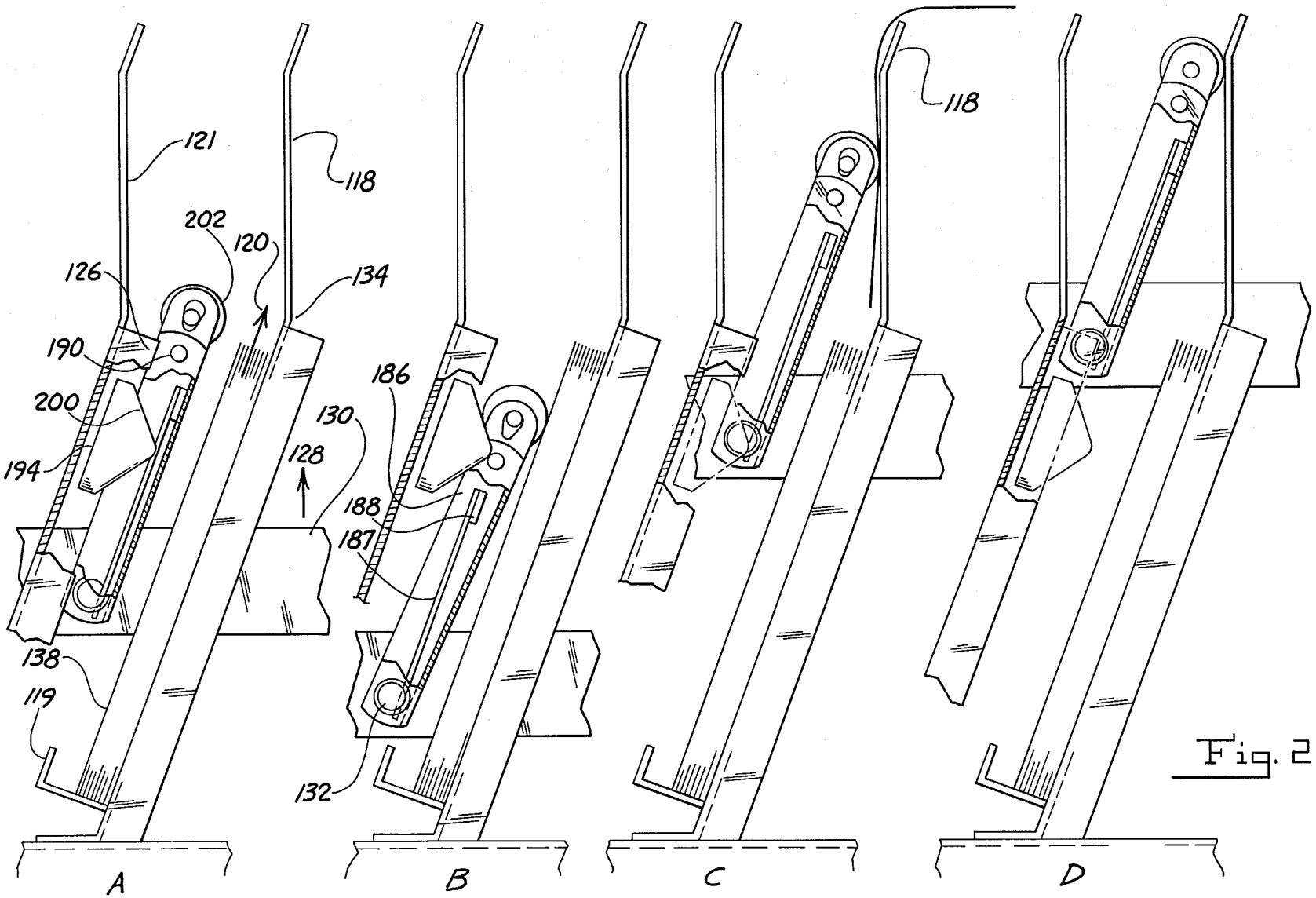
FIGS. 2A–D are a series of partial elevation views showing a sheet feeder moving from its home position (FIG. 2A) along its operative path (FIGS. 2C-D).

The pusher arm 126 comprises an elongated, hollow, U-shaped channel member 186 (FIG. 2). A strip 187 is angularly fixed to the shaft 132 and disposed within the channel 186. Magnet 188 is carried on the upper portion of the strip 187. When the pusher arm 126 is retracted, i.e., when pusher arm 126 lies adjacent the forward wall 121 (FIG. 2A), the magnet 188 holds the channel member 186 (made of iron) against strip 187. In this position, the channel member 186, and hence the pusher arm 126, will be held at the fixed angle of the strip 187, which angle parallels the wall 121. Thus, the pusher arm 126 will be held in a non-ejecting position, unless freed from the magnet 188, i.e., parallel and adjacent wall 121. This condition will prevail, even if the rail 130 continues to move up and down. This is so, because the channel 186 remains latched to strip 187, despite moving up and down with the rail 130. The parallelism of the channel 186 with the forward wall 121 will insure an unimpeded movement of the channel 186 in the non-ejecting position.

The pusher arm 126 is actuated to a sheet ejecting position, by unlatching the channel 186 from the magnet 188 and strip 187. When this unlatching takes place, as will be explained hereinafter, the pusher arm 126 will be cammed toward the wall 118. The pusher arm 126 will be biased toward the wall 118 under the influence of gravity, i.e., the center of gravity of the pusher arm 126 is such that it will fall towards the wall 118.

A fixed friction member 202, carried at the top of each pusher arm 126, will engage the inner-most sheet 122 in each bin, and push this sheet upwardly as the rail 130 and the pusher arms 126 move upwardly (arrow 128, FIG. 2). The sheet 122 will be ejected out of the top of the bin 104 as typically shown in FIG. 2C, when the rail 130 and the pusher arm 126 complete their upward travel. The rail 130, and hence the pusher arms 126, are then returned to the home position as shown in FIG. 2A.

A pin 190 is mounted on the outside of each channel member 186 and engages corresponding camming blocks 194 in the following manner. In the home position (FIG. 2A) the pusher arm 126 is disposed away from the stack of stored sheets 138, being held in that position by magnet 188. At the start of a collating cycle, rail 130 initially moves downwardly and pin 190 engages and follows the contours of upper camming surface 200 of block 194. Accordingly, pusher arm 126 becomes unlatched from magnet 188 as shown in FIG. 2B. As the collating cycle continues, rail 130 travels upward and carries pusher arm 126 toward overhead conveyor 106. At the top of its stroke (FIG. 2C), the pusher arm 126 has ejected the uppermost sheet 122 into the conveyor 106 which will carry the sheet 122 onto the jogger set finisher 124. Each cam is slidably movable into and out of its operative camming position with its corresponding pusher arm so that bins not in use will have their pushers held away from the empty bins.

It will be noted from FIGS. 1 and 2, that the bend 134 in wall 118 will cause the pusher arm 126 to move backwardly towards wall 121 as it proceeds in its upwad movement. At the height of the pusher arm travel, the pusher arm 126 will be seen to be parallel with the forward wall 121. In this position, the pusher arm will have its channel 186 relatched to magnet 188 and strip 187. Thus, on its travel back down the bin 104, the pusher arm will slide parallel to, or otherwise not interfere with, the remaining sheets in the bin.

There are many means available to one skilled in the art for ejecting sheets from bins. Hence, the foregoing explanation of the pusher arms is deemed sufficient for purposes of describing this invention. However, a more detailed description of the pusher arms may be found in U.S. Pat. Nos. 4,026,538 and 4,146,215, both of which are assigned to the assignee of this invention.

The movement or translatory motion of the rail 130 may be imparted in many ways obvious to one skilled in the art. In the machine 102 used to demonstrate the preferred embodiment, the rail 130 is driven by a rotation cam 140 that is coupled to the same axis 141 as a pinion gear 142. Worm gear 149 is coupled to the shaft 113 of motor 112 by belt 117.

As mentioned above, the ejected sheets are transported to the jogger 124. A sensitive switch S11 is disposed at the entry to jogger 124 for sensing jammed sheets. Once in the jogger, the sheets register against stops 147, 148. A stack of registered sheets is aligned and justified lengthwise by the operation of back jogging member 145 which urges the stack of sheets into alignment against stops 147, 148. The sheets are aligned widthwise by side guide 143 which moves toward opposite side guide 144. Once aligned, the set is fastened together by a solenoid actuated stapler 125 (See FIGS. 3, 4). After stapling, stops 147, 148 retract beneath the set of sheets and the stapled set is ejected from the jogger 124. A jogger is a well known apparatus and for a further explanation of one such jogger, see U.S. Pat. No. 4,073,391 issued Feb. 14, 1978 and assigned to the same assignee as is this invention.

The control system of the present invention is comprised of cycle cam 150, and the accompanying sheet feeding malfunction detecting means hereinafter described. The cycle cam 150 is mounted on a shaft 151 that is terminated in a pulley 152 and supported on a frame (not shown). The pulley 152 is coupled to driven axis 141 by belt 153. The cycle cam 150 has two camming detents 160, 162, located 180 degrees apart on the outer edge of cam 150. These detents sequentially pass switches S7, S8, S5 and S13 disposed about the periphery of the cam. When a detent passes a switch, the switch opens. Switch S7, the stop switch, and the miss detection sensing means are electrically connected through a series of relays to the power supply. Similarly, switch S13 and the bin jam detecting means are electrically connected through the same series of relays to the power supply. When a misfeed or jam occurs in the bins, or a bin becomes empty or the operator stops the machine, the electrical connection to the power supply will be interrupted when one or both of switches S7, S13 is opened by a passing detent. In either case, the collator will coast to a stop with the pusher arms 126 in the home position and the jogger will stop with its side guides 143, 144 closed. By stopping the pusher arms in the home position an operator has easy access to the bins for reloading or clearing a jam. With the side guides closed, the operator can adjust the side guides in accordance with the width of the sheets to be collated and jogged.

Switches S5, S8 control the operation of the jogger and stapler when they are operated independently of the collator. In particular, switch S8 activates the stapler and switch S5 interrupts the power to the jogger to bring it to rest with the stapled set ejected therefrom and the side guides 143, 144 in a new position with the side guides open in order to receive the next manually inserted set.

Figure 4:
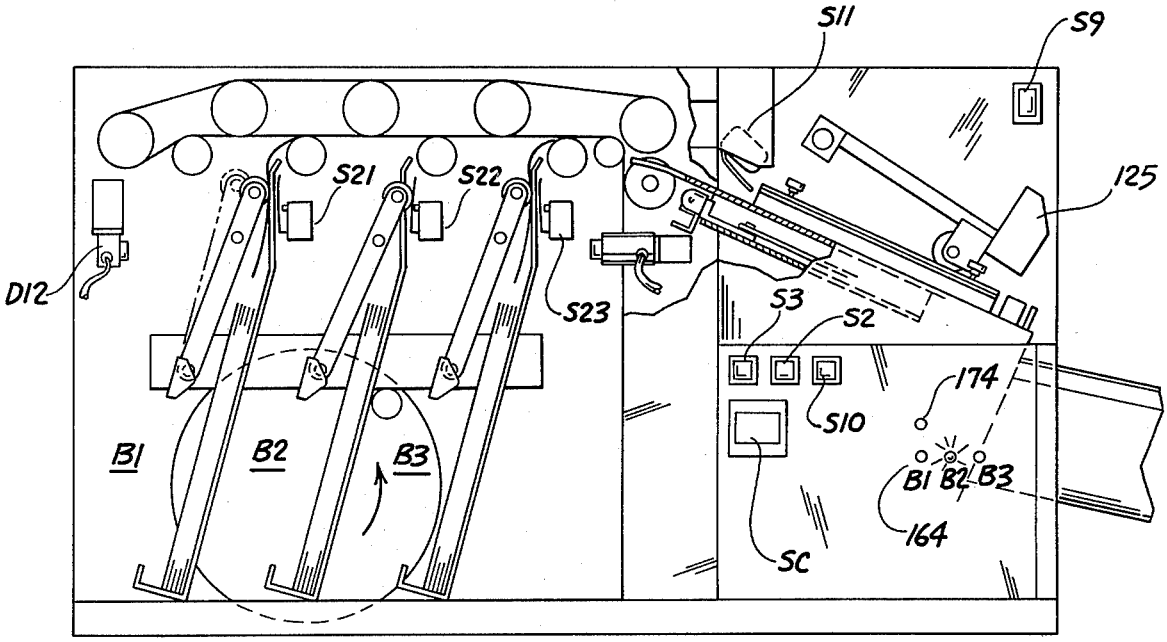
FIG. 4 is a schematic elevation view of FIG. 1 showing a misfeed in the center bin.

The miss detection sensing means comprises a plurality of bin switches S21-S21+n (where n is the number of bins). Each switch S21 has an actuator arm located in the path of movement of the pusher arm 126 and is disposed on the opposite side of wall 118 of bin 104 behind an aperture. When sheets are fed, the sheet covers the aperture and prevents the pusher arm 126 from closing switch S21. However, as shown in FIG. 4, when the pusher arm in bin B2 fails to feed a sheet, the pusher arm passes through the corresponding aperture, thereby actuating switch S22 which lights up a corresponding bin misfeed indicator light of the array 164. As described above, the collating cycle will continue until all the pusher arms 126 return to the home position shown in FIG. 2A.

Figure 3:
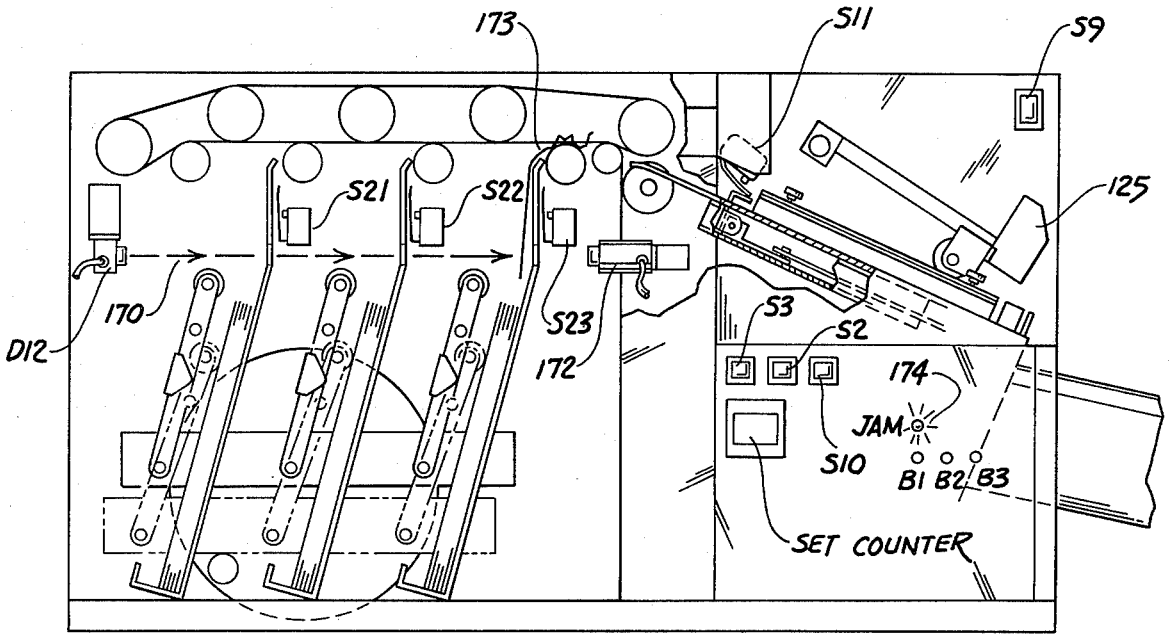
FIG. 3 is a schematic elevation view of FIG. 1 showing a sheet jammed in a bin.

The bin jam detection system is illustrated in operation in FIG. 3. There a light signal indicated by arrow 170 is shown emitted from an infrared light source D12 that is focused on a light signal detector 172. Reception is interrupted by a jammed sheet 173, whereupon jam indicator light 174 is lit, and the collating machine will coast to rest in the home position.

The jogger jam detection sensing means comprises the sensitive switch S11 that has its actuator arm disposed at the entry to jogger 124. If a sheet is jammed at the entry to the jogger, the back jogger member 145 will move the sheet against the actuator arm whereupon the collator and jogger will stop immediately.

Having described the mechanical structure in which the control system is used, reference is now made to FIGS. 5A-B where the systems control circuit is described in connection with the operation of the machine, and, in particular, the cycle cam 150.

Figure 5A:
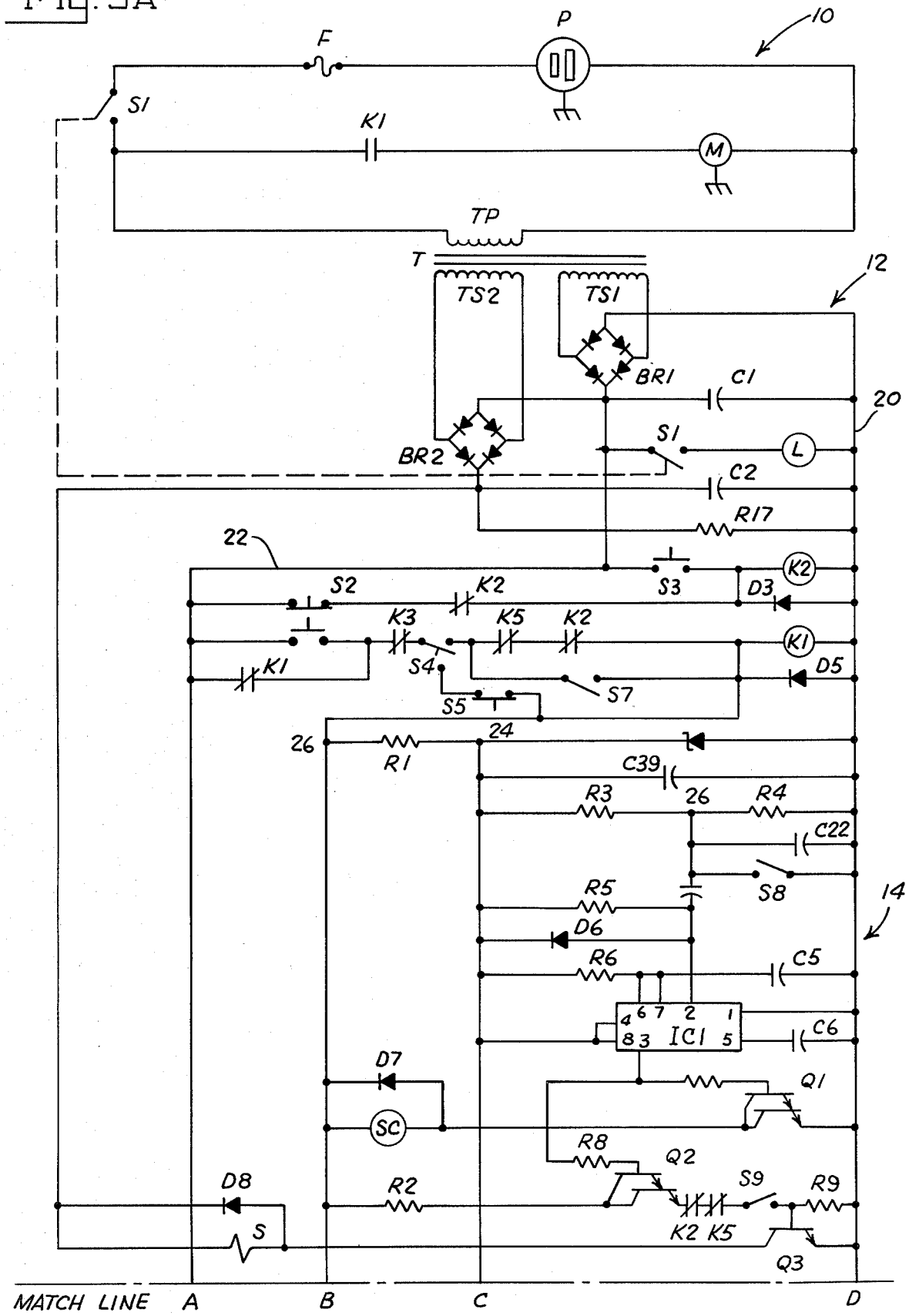
FIGS. 5 A and B are an electrical schematic embodying the control circuit of the present invention.
Figure 5B:
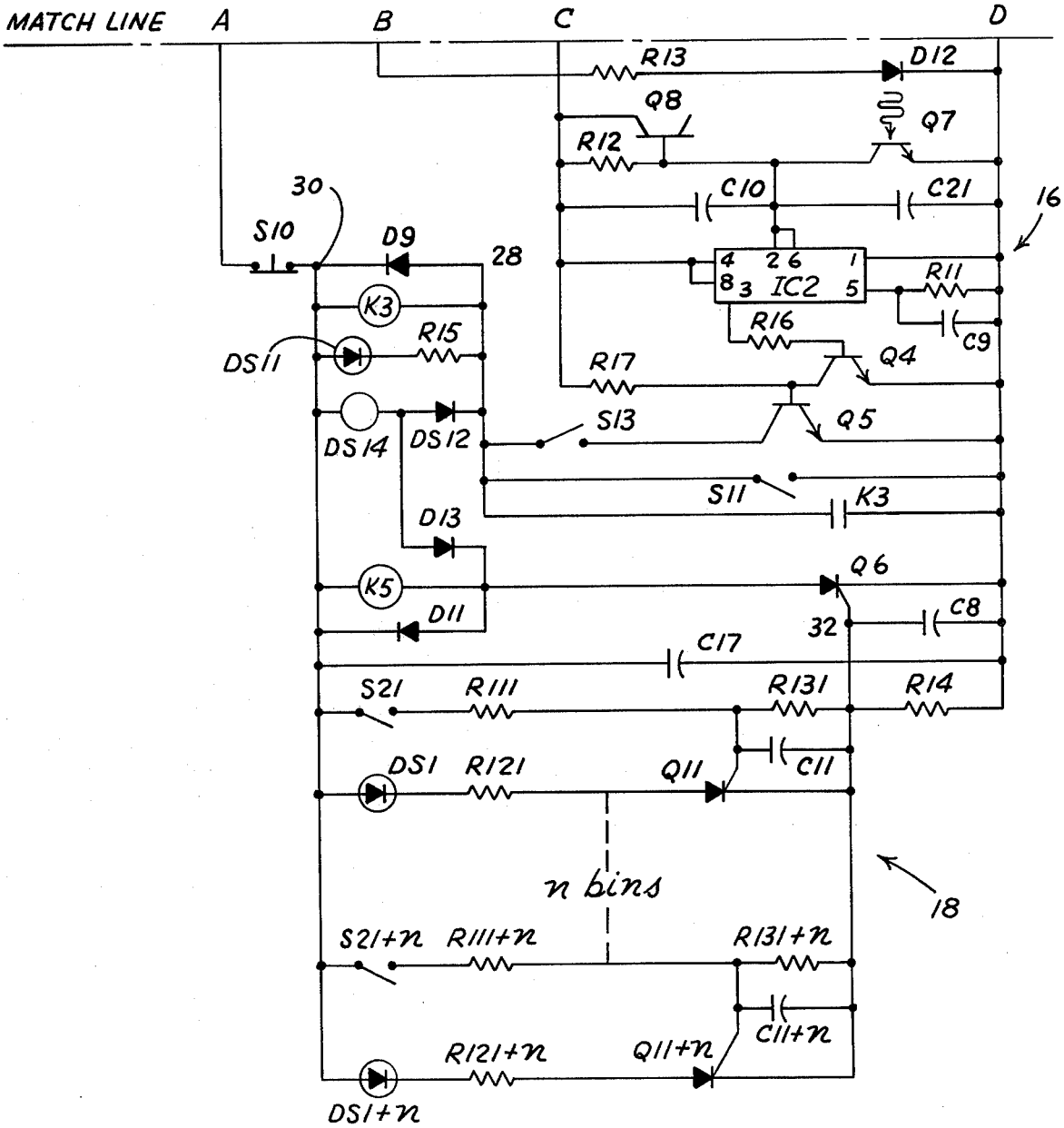

FIGS. 5A and 5B illustrate the system control 10 for systematically controlling electromechanical operations of an automatic collator-jogger set finisher where the set finisher consists of a sheet jogger 124 and attached stapler 125. The two sheets of drawings, FIGS. 5A and 5B, illustrate electrical circuit 10 where the two sheets of drawings are aligned together into the following four sections. The first section is dual voltage power supply section 12, the second is a stapler and counter driver section 14, the third is jam sheet detection section 16, and the fourth is misfeed detection section 18.

The dual voltage power supply section 12 consists of an AC plug P which provides electrical power from a power source such as an ordinary wall socket to electrical circuit 10. Fuse F and one pole of a double pole double throw power switch S1 connects in series to one side of the plug P. Power relay contacts K1 and a motor 126 in series connect to another side of the DPDT switch S1 and the other side of the plug P. Transformer primary winding TP of transformer T connects across the series connection of the power relay contacts K1 and the motor 126 plus one pole of the DPDT switch S, the fuse F, and the plug P. A full wave bridge rectifier BR1 connects to a transformer secondary winding TS1, one of the two secondary windings of transformer T. Power supply filter capacitor C1 and the other pole of the DPDT power switch S1 connects from the positive output side of the bridge rectifier BR1 to the power on indicator lamp L. The other side of power on indicator lamp L connects to the common ground bus 20. Power bus line 22 illustrated as a heavy black line connects to the positive side of the bridge rectifier BR1.

A full wave bridge rectifier BR2 connects to transformer secondary winding TS2. The negative side of the bridge rectifier BR2 connects to the positive side of the bridge rectifier BR1 so that the rectified voltage of the bridge rectifier BR1 is summed with the rectified voltage of the bridge rectifier BR2. Filter capacitor C2 and bleeder resistor R17 connect from the positive side of the bridge rectifier BR2 to the common ground bus 20.

The direct current power of the bridge rectifier BR2 connects to stapler solenoid S thereby driving the stapler 125 attached to a jogging deck of the jogger 124. The other side of the stapler solenoid S connects to the collector of the power switching transistor Q3. Transient suppression diode D8 connects across the stapler solenoid S having its cathode connected to the power bus line 22.

Stop switch S3 (also shown in FIGS. 3 and 4) in series with stop relay coil K2 connects from the power bus line 22 to the common ground bus 20 and stops the operation of the collator-jogger set finisher. One pole of a double pole double throw start switch S2, the stop relay contacts K2, and a transient suppression diode D3 connect in series from the power bus line 22 to the common ground bus 20. The anode of transient suppression diode connects to the common ground bus 20.

The junction of the stop switch S3 and the rely coil K2 connects to the junction of the stop relay contacts K2 and the cathode of the transient suppression diode D3. The second pole of the double pole double throw start switch S2 (also shown in FIGS. 3 and 4), jam relay contacts K3, set finish mode switch S4 actuated by a cover (not shown) on the collator conveyor system, miss relay contacts K5, stop relay contacts K2, and power relay coil K1 connect in series from power bus line 22 to common ground bus 20. The power relay contacts K1 in parallel with the second pole of the double pole double throw start switch S2. Miss detection control switch S7 which rides cam 150 connects from the junction of the jam relay contacts K3 and the miss relay contact K5 to the junction of the stop relay contact K2 and the relay coil K1. A set finish cam timing switch S5 also rides cam 150 and connects from switch S4 to point 26 of coil K1. A transient suppression diode D5 connects across the power relay coil K1 with its anode connected to the common ground bus 20.

Resistor R1 in series with a zener diode Z1 connects from the junction of the stop relay contacts K2 and power relay coil K1, point 26, to common ground bus 20. Polarized capacitor C39 connects in parallel with the zener diode Z1 with the negative terminal of the capacitor C39 connecting to common ground bus 20. The resistor, R1, the zener diode Z1, and the polarized capacitor C39 supply power to the stapler driver and set counter section 14, and the jam detector section 16.

The stapler driver and set counter section 14 includes voltage limiting resistors R3 and R4 connect in series from point 24, the junction of the resistor R1 and the zener diode Z1, to common ground bus 20. A transient suppression capacitor C22 and a stapler cam timing switch S8 which rides on cam 150 are in parallel and connect from the junction of voltage limiting resistors R3 and R4, point 26, to common ground bus 20. Resistor R5 connects from point 24 to differentiating capacitor C4 which connects to point 26.

A NE555 integrated circuit ICI connected in a one shot multivibrator oscillator configuration controls activation of a stapler solenoid S and a set counter SC (also shown in FIGS. 3 and 4). Pin 1 of ICI connects to common ground bus 20. Pin 2 of ICI connects to the junction of the differentiating capacitor C4 and the resistor R5. A diode D6 connects from the point 24 with its mode connected to the pin 2 of ICI for transient suppression of negative pulses on the pin 2. Pin 4 and pin 8 of ICI connect to the point 24. A resistor R6 connects from the point 24 to pins 6 and 7 of ICI. A capacitor C5 connects from pins 6 and 7 to the common ground bus 20. The frequency of oscillation of ICI is determined by the series connection of the resistor R6 and the capacitor C5. A transient suppression capacitor C6 connects from pin 5 of ICI to the common ground bus 20. Pin 3 of ICI, the output, connects to base resistors R7 and R8 of Darlington pair transistors Q1 and Q2 respectively. Darlington pair transistor Q1 drives set counter SC and Darlington pair transistor Q2 switches a power transistor Q3 actuating a stapler solenoid S.

The set counter SC connects from point 26 to the collector of the Darlington pair transistor Q1. The emitter of Darlington pair transistor Q1 connects to the common ground bus 20. A transient suppression diode D7 connects across the set counter SC with its anode connected to the common ground bus 20. A resistor R2 connects from point 26 to the collector of the Darlington pair transistor Q2. In series with the emitter of the Darlington pair transistor Q2 are stop relay contacts K2, miss relay contacts K5, stapler on switch S9, and resistor R9 which connect to the commom ground bus 20. The base of the power switching transistor Q3 connects to the junction of the stapler on switch S9 and the resistor R9. The other side of the solenoid S connects to the collector of the power switching transistor Q3 while its emitter connects to the common ground bus 20.

Jam sheet detection section 16 derives power from point 24 for the logic circuitry and point 26 for a light emitting diode source D12. The resistor R13 and the light emitting diode D12 connect in series between point 26 and the common ground bus 20. Transistor Q7 receives light from the light emitting diode D12. The emitter of transistor Q7 connects to the common ground bus 20 and the collector is in series with the resistor R12 which connects to point 24. The collector of emitter follower transistor Q8 connects to point 24 and the base connects to the junction of the resistor R12 and the collector of transistor Q7. When the voltage measured between the connected emitter of Q8 and ground bus 20 is zero, the l.e.d. 20 is focused on transistor Q7.

A NE555 integrated circuit IC2 connected in a Schmidt Trigger configuration to control the jam circuitry. The junction of resistor R12 and the collector of transistor Q7 connects to pins 2 and 6 of integrated circut IC2. A transient suppression capacitor C10 connects from point 24 to pins 2 and 6 of integrated circuit IC2. A transient suppression capcitor C21 connects from pins 2 and 6 of integrated circuit IC2 to common ground bus 20. Pin 1 of integrated circuit IC2 connects to common ground bus 20. A transient protection capacitor C9 and load resistor R11 connect from pin 5 of integrated circuit IC2 to common ground bus 20. Pins 4 and 8 of integrated circuit IC2 connect to point 24. A base current limiting resistor R16 connects from the output of pin 3 of integrated circuit IC2 to the base of transistor Q4. A base current limiting resistor R17 connects from point 24 to the collector of transistor Q4. The emitter of transistor Q4 connects to common ground bus 20.

A reset switch S10 (also shown in FIGS. 3 and 4) connects between the output of the bridge rectifier BR1 and point 30. A jam relay coil K3 connects between points 28 and 30. Transient suppression diode D9 connects between points 28 and 30 with its anode connected to point 28. A light emitting diode jam light DS11 (174 in FIGS 3 and 4) in series with resistor R15 connects between points 28 and 30 with its anode connected to point 30. Reset light DS14 in series with a contact saver diode DS12 connects between points 28 and 30 with the cathode of diode DS12 connected to point 28. The base of transistor Q5 connects between the junction of resistor R17 and the collector of transistor Q4. A pusher timing switch S13 rides on cam 150 and connects from point 28 to the collector of transistor Q5. The emitter of transistor Q5 connects to common ground bus 20.

Jogger jam switch S11 which is located at the infeed end of the jogger detects jammed sheets. Jam relay contacts K3 connect between point 28 and common ground bus 20. From point 30, a miss relay coil K5 connects in series with a silicon controlled rectifier Q6 with the cathode of Q6 connected to common ground bus 20. The gate of silicon controlled rectifier Q6 connects to point 32. The cathode of transient protection diode D11 connects to point 30, and its anode connects to the junction of miss relay coil K5 and the anode of silicon controlled rectifier Q6. A contact saver diode D13 connects to the junction of reset light DS14 with its cathode connected to the junction of miss relay coil K5 and the anode of silicon controlled rectifier Q6. A contact saver diode DS12 connects to point 28 with its cathode connected to one side of reset light DS14.

Miss detection section 18 of the collator-jogger set finisher indicates a missed sheet ejection condition through the array light emitting diode 164 corresponding to each sheet storage bin. Point 30 supplies power to the miss detection section circuitry 18. Capacitor C17 connects from point 30 to the common ground pins 20 to suppress transients. From point 32, the gate of silicon controller rectifier Q6, capacitor Q8 and resistor R14 connect to the common ground bus 20 to provide proper impedance across the gate in the event of power line fluctuations or transient voltages.

The circuitry for each individual sheet storage bin 104 has the following components. From point 30, switch S21 conects in series with resistor R11 and resistor R131 to the gate of SCR Q6, point 32. Also, from point 30, light emitting diode DS1 connects in series with resistor R121 and the anode of SCR Q111 having its cathode connected to the gate of SCR Q5, pin 32. The gate of SCR Q111 connects to the junction of resistors R111 and R131. A transient suppression capacitor C11 connects from the gate of SCR Q11 to point 32.

For each additional collator sheet receiving storage bin up to the nth collator bin, the same components as described in the above paragraph connect in the same configuration as described for the first collator bin. This includes switch S21+n which connects in series with resistor R11+n and R131+n between point 30 and the gate of SCR Q6, point 32. Also, light DS1+n which connects in series with R121+n and SCR+n between the point 30 and 32. The gate of SCR Q11+n connects to the junction of R111 and R131+n. Transient suppression capacitor C11+n connects from the gate of SCR+n to point 32.

PREFERRED MODE OF OPERATION

Power to collator-jogger set finisher 102 is supplied through the AC plug which may be an europa type input receptacle. Line power is supplied from the plug P to power the control relay K1 having normally opened contacts in series with the drive motor 112 which is a full load capacitor start motor and the primary TP of the transformer T which is in parallel with the power control relay K1 and the motor 112.

The dual voltage power supply section 12 utilizing bridge rectification consists of a 24-volt direct current supply and a 36-volt direct current supply. The 24-volt direct current supply is derived from an 18-volt transformer secondary TS1, the bridge rectifier BR1, and the filter capacitor C1. The 36-volt supply is obtained by adding the 24-volt supply to a 12-volt supply derived from the 9-volt transformer secondary TS2, the bridge rectifier BR2, and filter capacitor C2. The 36-volt supply is for the stapler solenoid S and the 24-volt supply is for the control relays, miss feed detection, jam feed detection, and the stapler circuits.

The stapler and counter-driver section 14 has a stapler drive circuit which supplies a time pulse 40 milliseconds long (independent of the stapler cam switch closure S8) to the Darlington pair transistor Q1 and to the drive power transistor Q3 to drive the set counter SC and the stapler solenoids S respectfully. The 15-volt power supply for the timer is derived from resistor R1, zener diode Z1, and filter capacitor C39. Voltage limiting resistors R3 and R4, resistor R5, and capacitor C4 along with the stapler cam switch S8 supply a negative differentiated pulse to pin 2 of a NE555 integrated circuit ICI to to initiate the timing cycle having a trigger point which is one third of the voltage supply. The transient suppression capacitor C22 filters bounce on opening of stapler cam switch S8. The diode D6 provides protection against a positive pulse of pin 2 of integrated circuit ICI. Resistors R5 provides a charging path for differentiating capacitor C4 which determines the reset time of integrated circuit ICI. At initiation of a pulse at the output of integrated circuit ICI, pin 3 switches high supplying the Darlington pair transistor Q1 and the Darlington pair transistor Q2 with base current. The Darlington pair transistor Q1 drives the set counter SC directly and the Darlington pair transistor Q2 supplies base current to power switching transistor Q3 through stapler on-off switch S9 normally closed miss relay contacts K2 and K5 disable power switching transistor Q3 and solenoid S after a miss sheet or stop signal is received. The power switching transistor Q3 drives solenoid S with a 36-volt 9 ampere pulse for 40 milliseconds every 1.8 seconds constituting a low duty cycle. Solenoid S is a 6-volt solenoid being driven with a 36-volt pulse. The duration of the pulse is determined by the resistor R6 and the capacitor C5 where the period of the pulse is equal to 1.1 R6×C5. When the voltage across the capacitor C5 reaches two-thirds of the voltage supply, the integrated circuit ICI resets and the output pin 3 drops to its low state therefore cutting off the base supply to the Darlington pair transistor Q1, the Darlington pair transistor Q2, and the power switching transistor Q3 which in turn de-energizes set counter SC and solenoid S.

The jam detection system 16 utilizes a photoamplifier coupled to a Schmidt Trigger amplifier to detect paper flow jams in the sheet receiving storage bins and a jogger jam switch S11 detects collated sheets which do not feed into the jogger-set finisher areas properly. The photoamplifier consists of a pre-focused light-emitting diode source D12 mounted on two angle brackets for easy alignment at one end of a plurality of sheet receiving storage bins in the collator and light receiver Q7 phototransistor with condensing lens mounted in a housing at the other end of the collator. The light beam travels through a hole line in the plurality of sheet receiving storage bins and is broken by the sheets each time as the sheets are fed in unison from the bins upward into the conveyor system during each collating cycle. The light beam travels through a hole cut in a portion of each sheet receiving storage bin. The light receiver transistor Q7 is connected to the input of the NE555 integrated circuit IC2 which is connected in a Schmidt trigger amplifier configuration. Resistors R12 and R11 determine the trigger point and impedance of the integrated circuit IC2 respectively. The voltage measured between the emitter of Q8 and ground bus 20 is zero when the light source D12 is in alignment with the light receiver Q7. The output of integrated circuit IC2 is high when light is present on light receiving transistor Q7 thereby supplying base current to the transistor Q4. The output of the transistor Q4 is inverted by the transistor Q5 so that Q5 is off when Q7 is light. Pusher timing switch S13 is timed to close at the point in a cycle when all the sheets are pushed or pulled from the sheet receiving storage bins. If a sheet or sheets are hung up or caught in the bins, light receiver transistor Q7 will be dark thereby turning on transistor Q5 so that jam relay K3 will energize and latch when pusher timing switch S13 closes. Normally closed contacts of jam relay K3 open to drop out power relay K1 thereby stopping the machine immediately. The light emitting diode D11 located on the front panel lights indicating a paper flow jam and reset switch indicator D14 also lights to indicate that reset is required. Clearing the jam normally requires opening the conveyor cover, removing damaged pages, repairing the incomplete set, closing the cover, actuating the reset switch and then the start switch to continue the collating run. Jogger jam switch S11 will be actuated by the back jogger if the paper does not feed into the jogger area properly. Jogger jam switch S11 will actuate jam relay K3 in the same manner described above thereby stopping the machine.

The miss detection system 18 consists on individual bin miss detection in each bin which is obtained with microswitches S21 through S21+n mounted in a top portion of the rear of each sheet receiving storage bins so that each individual switch S21—S21+n is actuated by the sheet pusher arm 126 when no paper is present during feeding of each collation cycle. When the pusher arm misses a sheet or the bin is empty, the pusher arm pushes upward against an empty bin surface moving past a hole in the bin whereupon it subsequently falls into the hole actuating the microswitch S21 through S21+n. If a sheet were present, the pusher arm would not be permitted to fall through the hole, but would push the sheet past and beyond the hole. Actuation of any switch or switches when a misfeed occurs supplies gate current to a silicon controlled rectifier Q11 through Q11+n which turns on, latches in, and supplies current to light emitting diode indicator DS1 through DS1+n and supplies gate current to silicon controlled rectifier Q6 which turns on and latches in energizing miss relay K5. When miss relay K5 latches in, normally closed contacts of miss relay K5 open disabling the drive power transistor Q3 and the stapler solenoid S. Also, the normally closed contacts in the miss relay K5 open the circuit in parallel with the cycle cam switch S7 which is affixed to the rotating cam 150 allowing the machine to continue to a home position whereupon opening of switch S7 thereby de-energizes power relay K1 which de-energizes motor 112 thereby stopping the machine. In a home position, the sheet pusher arms are at a convenient location where they are cammed away from the stack of sheets. Resistors R111 through R111+n and capacitors C111 through C111+n for improved stability and dv/dt rating. Resistors R111 through R111+n limit the gate current to transistor Q111 through Q111+n in addition to determining the current for light emitting diodes DS1 through DS1+n.

At a time where a misfeed is detected, light emitting diodes DS1 through DS1+n of the array 164 located on the front panel of the machine indicate which bin or bins emptied of sheets or had a misfeed occur. The machine is stopped in a home position with the pushers cammed away from the stack of sheets, side guides of the sheet jogger closed, and the incomplete set located in the jogger area unstapled.

The operator has two alternative methods or repairing a set in a misfeed condition. The first method of repairing an incomplete set requires opening the conveyor cover, removing the set by opening the side guides of the jogger-set finisher, correcting the set by adding the missing page or pages, replacing the set in the jogger, closing the machine cover, actuating the reset switch S10 and the start switch S2 in this order. The repaired set is then stapled and subsequently ejected. The second method of repairing the incomplete set requires momentary actuation of the start switch S2 without actuating the reset switch S10 thereby energizing power relay K1 and motor 112. This allows the machine to move through one complete collation cycle and stop again in the home position. The incomplete set is ejected into the stacker tray where it can be removed and corrected whereupon the reset switch S10 and the start switch S2 are then actuated in order to continue the machine operating. The second method requires hand stapling of the faulty set.

The manual controls of the collator-jogger set finisher machine consists of the power switch S1, the start switch S3, the stop switch S2, the reset switch S10, and the stapler on-off switch S9. To operate the machine, the power switch S1 is actuated and then start switch S3 is actuated. If there is no jam or miss condition, that is the jam relay K3 or miss relay K5 are not energized, start switch S2 which is normally open will energize power relay K1. The power relay latches in through the normally open contact of power relay K1 and energize the motor M through the normally open contacts of power relay K1. Collating jogging-set finishing now takes place with the machine collating a plurality of sheets of a predetermined order into a bundle which is subsequently jogged and stapled if so desired until a jam occurs, a miss occurs, or the stop switch S3 is actuated.

When stop switch S3 is actuated, the machine does not stop instantly but it continues operating until it reaches the home position with the sheet pusher arms cammed up off the paper and the side guides of the sheet jogger closed. This allows a machine operator to reload the sheet receiving storage bins without interference from the pushers and also allows an operator to check the jogger side guide and back jogger setting. To accomplish this feature, stop switch S3 energized stop relay K2 which latches in through normally open contact of stop relay K2. Also, the normally closed contact of stop relay K2 is opened so that the power relay K1 will de-energize when S7 is released at the home position. Reset switch S10 de-energizes jam relay K3 and misrelay K5 so that the machine can be restarted after a jam or a miss occurs. Stapler on-off switch S9 allows for a selection of stapling or a non-stapling operation.

The set finisher mode utilizing the jogger-stapler independently of the collator is engaged when a conveyor cover (not shown) is opened actuating and opening switch S4 and disconnecting the collating stop circuit S7 but reconnecting the set finish cam switch S5. When the collator conveyor cover is opened, the switch S4 is opened operating the set finisher and thereby causing the jogger to stop in an open position through cam switch S5 located on the timing cycle cam shaft. In this mode, the operator actuates the start button and the jogger 124 will cycle once and stop with the jogger side guides 141, 143 open allowing a hand married set to be inserted. The operator then actuates the start button whereupon the jogger jogs, staples and ejects the set. The machine comes to rest with the side guides open ready for the next set.

Various modifications are contemplated and may obviously be resorted to by those skilled in the art without departing from the apparent scope of the invention as hereinafter defined by the appended claims.

What is claimed is:

1. In a collator having an operative cycle during which a set of sheets is collated and including a plurality of sheet storage bins, each of said bins having an access thereto and comprising a wall having a first and a second portion, the first portion supporting sheets inserted into the bin and said second portion providing a means for guiding said sheets as they are fed out of said bin wherein a sheet being fed from said bin passes only momentarily over said second portion, a corresponding plurality of sheet feeders, each feeder being operatively associated with a corresponding bin, means for cyclically moving said feeders from a home position, in which position each feeder does not obstruct the access to its bin, along a predetermined operative path longitudinally extending adjacent said first and second portions to allow a sheet feeder to engage and carry a sheet from said first portion over and beyond said second portion and returning to said home position preparatory to another cycle of operation and wherein each feeder, if stopped in the course of said operative path, would obstruct the access to its corresponding bin, and wherein the second portion of said wall includes an aperture located in the operative path of its respective feeder, and drive means for moving said sheet feeders along said predetermined path, a control system comprising:

means for sensing a sheet feeding malfunction during a cycle of operation, said sensing means including a plurality of misfeed and nonfeed detectors corresponding to the number of bins, each misfeed and nonfeed detector comprising a switch having an actuator disposed in a respective aperture whereby the aperture is normally bridged by a sheet as the sheet is fed out of the bin by the sheet feeder and the sheet feeder passes through the aperture to activate the switch when the sheet feeder fails to feed a sheet from the bin, means responsive to said sensing means and operatively associated with said drive means for (a) continuing the cyclical operation of said sheet feeders after a sheet feeding malfunction is sensed and (b) stopping said sheet feeders in said home position before another cycle begins whereby the sheet feeding malfunction can be readily corrected through the access provided to each of said bins when said sheet feeders are in their respective home positions.

2. The invention of claim 1 wherein said sensing means comprises a photoelectric detection system for detecting sheets jammed in said bins including a light source disposed at one end of said plurality of adjacent bins for emitting a light signal, a light signal detector disposed at said other end of said plurality of bins for detecting the light signal emitted by said source, and a corresponding plurality of holes in said bins through which the light signal may pass from the source to the light signal detector.

3. The invention of claim 2 further comprising an indicating means responsive to said jam detection means for indicating that a jam has occurred.

4. The invention of claim 1 further comprising a plurality of indicating means responsive to said misfeed and nonfeed detectors for indicating each bin where a misfeed or nonfeed occurs.

5. The invention of claim 1 wherein said means responsive to said sensing means comprises a cycle cam switch operatively connected to said drive means and responsive to said sensing means for interrupting said drive means in order to stop said sheet feeders in their home positions when a sheet feeding malfunction is sensed by said sensing means.

6. The invention of claim 1 wherein said collator further comprises a jogger having an entry portion for receiving sheets ejected from said bins, side guides movable between an open position and a closed position for aligning the edges of said ejected sheets, a stapler for fastening together sets of aligned sheets and said sensing means further comprises means for determining a sheet jam at the entry portion of the jogger.

7. The invention of claim 6 wherein said control system further comprises a jogger and stapler mode selection means operatively connected to said drive means for disabling said sheet feeders and for operating said jogger and stapler in order to align and fasten together a set of sheets inserted into the jogger.

8. The invention of claim 7 wherein said jogger and stapler mode selection means comprises a mode selection switch operable to disable said sheet feeders, and a cycle cam switch responsive to said mode selection switch and operatively connected to said drive means for operating said jogger for one cycle wherein a set of sheets inserted into said jogger is aligned and fastened together by said stapler, and for stopping the jogger with the side guides in their open position to receive another set of sheets.

9. The invention of claim 6 further comprising means for ejecting a set of sheets from said jogger and said control system further comprises means for selectively operating said jogger to restart for one cycle whereby an incomplete set of sheets is ejected from the jogger.

10. The invention of claim 6 further comprising means responsive to said sensing means for disabling said stapler until an uninterrupted cycle is completed.

11. The invention of claim 6 further comprising means responsive to said jogger sheet jam determining means for indicating that a jam has occurred.

12. The invention of claim 1 wherein said control means further comprises means for restarting said drive means for continued cyclical operation until a misfeed, nonfeed or jam is sensed.

13. The invention of claim 1 wherein said control system further comprises an operator actuable stop switch and means responsive to said stop switch and coupled to said drive means for stopping said sheet feeders in their home positions.

14. A combined collating, jogging and stapling system having an operative cycle during which a set of sheets is sequentially collated, jogged into alignment, and fastened together, comprising:

A. a stapler for fastening together a set of jogged sheets;

B. a jogger operatively associated with said stapler and having a pair of side guides cyclically reciprocably movable between an open position for receiving a set of collated sheets and a closed position to align the sides of a set of received sheets;

C. a plurality of adjacent sheet storage bins each having an access thereto, each bin comprising a wall having a first and a second portion, the first portion supporting sheets inserted into the bin and said second portion providing a means for guiding said sheets as they are fed out of said bin wherein a sheet being fed from said bin passes only momentarily over said second portion;

D. a corresponding plurality of sheet feeders each operatively associated with a corresponding bin, means for cyclically moving said feeders from a home position, in which each feeder does not obstruct the access to its bin, along an operative path longitudinally extending adjacent said first and second portions to allow a sheet feeder to engage and carry a sheet from said first portion over and beyond said second portion and returning to said home position preparatory to another cycle of operation, wherein each feeder if stopped in the course of said operative path would obstruct the access to its corresponding bin, and wherein the second portion of said wall includes an aperture located in the operative path of its respective feeder;

E. a conveyor operatively associated with said sheet feeders and said jogger for conveying sheets ejected from said bins to said jogger;

F. means defining a predetermined path along which said sheets are ejected out of said bins and conveyed by said conveyor to said jogger;

G. means operatively disposed along said predetermined path for sensing a sheet feeding malfunction, said sensing means including a plurality of misfeed and nonfeed detectors corresponding to the number of bins, said misfeed and nonfeed detectors comprising a plurality of switches, each switch having an actuator arm located in a respective aperture whereby the aperture is normally bridged by a sheet as the sheet is fed out of the bin by the sheet feeder and the sheet feeder passes through the aperture and actuates the corresponding switch when the sheet feeder fails to feed a sheet; and H. cycle means operatively connected to said stapler, jogger, conveyor and sheet feeders, and responsive to said sensing means for (a) normally cyclically operating said system, (b) continuing the cyclical operation of said system after a sheet feeding malfunction is sensed and (c) stopping the system before the stapler operates and after the sheet feeders are in their respective home positions.

15. The invention of claim 14 wherein said bins further comprise a corresponding plurality of holes disposed in the path of travel of said sheets out of said bins and said sensing means further comprises a light source disposed at one end of said bins for sending a light signal through said plurality of holes, and a light receiver disposed at the opposite end of said bins for receiving said light signal, whereby a sheet jammed in said bins is sensed by the receiver when a sheet covers a hole and thereby interrupts the passage of light from the source to the receiver.

16. The invention of claim 14 wherein said system further comprises means operatively, connected to said cycle means and to said stapler, jogger, conveyor and sheet feeders and operable for restarting said combined collating, jogging and stapling system after a sheet feeding malfunction has been corrected.

17. The invention of claim 16 further comprising means for ejecting a set of sheets from said jogger and means for selectively disabling said sheet feeders and for operating said restarting means for one cycle in order to eject a set of sheets from said jogger and for stopping the sheet feeders in their home position.

18. The invention of claim 14 further comprising a jogger and stapler mode selection means for selectively operating the system for one cycle wherein a set of sheets is jogged, aligned and fastened together and said jogger stops in a position with its side guides open.

* * * * *